United States Patent [19]

Betts et al.

[11] 4,257,741

[45] Mar. 24, 1981

[54] TURBINE ENGINE BLADE WITH AIRFOIL PROJECTION

[75] Inventors: Robert K. Betts, Cincinnati; John J. Grisik, Middletown; John W. Zelahy, West Chester, all of Ohio

[73] Assignee: General Electric Company, Cincinnati, Ohio

[21] Appl. No.: 957,279

[22] Filed: Nov. 2, 1978

[51] Int. Cl.[3] ..... F01D 5/22

[52] U.S. Cl. ..... 416/190; 416/191; 416/196 R

[58] Field of Search ..... 416/190, 191, 193, 196, 416/224

[56] References Cited

U.S. PATENT DOCUMENTS

| | | | |
|---|---|---|---|
| 2,421,890 | 6/1947 | Johansson | 416/196 |
| 2,772,854 | 12/1956 | Anxionnaz | 416/196 X |
| 2,936,155 | 5/1960 | Howell et al. | 416/193 A |
| 3,104,093 | 9/1963 | Craig et al. | 416/190 |
| 3,327,995 | 6/1967 | Blackhurst et al. | 416/190 |
| 3,545,882 | 12/1970 | Williamson | 416/190 |
| 3,576,377 | 4/1971 | Beanland et al. | 416/191 |
| 3,588,980 | 6/1971 | Cogan | 416/196 X |

*Primary Examiner*—Everette A. Powell, Jr.
*Attorney, Agent, or Firm*—Lee H. Sachs; Derek P. Lawrence

[57] ABSTRACT

A turbomachinery blade, which includes an airfoil and a projection from the airfoil for the purpose of abutting contact with the surface of an adjacent member is provided with a surface means having an improved combination of adhesive wear resistance and impact toughness through the attachment to the contact surface of a discreet wear pad. The pad comprises a substantially fully dense, compacted, sintered member of a material selected from carbides, nitrides and borides, with or without a suitable binder, the pad being of a thickness of at least about 0.01 inches and having thermal expansion characteristics compatible with the projection over the range of intended operating temperature.

2 Claims, 4 Drawing Figures

TURBINE ENGINE BLADE WITH AIRFOIL PROJECTION

The invention herein described was made in the course of or under a contract or subcontract thereunder (or grant) with the Department of the Navy.

FIELD OF THE INVENTION

This invention relates to turbomachinery blades and, more particulary, to the type which includes airfoil projections such as for providing shrouds, platforms, damping members, etc.

BACKGROUND OF THE INVENTION

A variety of turbomachinery such as gas turbine engines which include axial flow compressors or fans or bypass arrangements utilize projections such as midspan or tip shrouds or other damping means to reduce vibratory loading on blade airfoils. Because adjacent surfaces of such projections or shrouds are in direct contact during engine operation, impact and a type of sliding wear sometimes called adhesive wear occurs at points of contact. It is generally believed that adhesive wear may occur from a combination of impacting and rubbing which produces a repetitive scuffing action of the type produced by vibratory loading during operation of the gas turbine engine. Such adhesive wear can occur between the type of projections mentioned above and the term "projection" is intended to include a variety of protruberances or projections from an airfoil for the purpose of defining at least a portion of a shroud, platform or damping member.

Prior to the present invention the contact surfaces between such members had been provided with a surface means in the form of a coating, typically tungsten carbide in a binder such as cobalt, applied by spray deposition methods. However, during operation of gas turbine engines including such a coating, it had been recognized that undesirable spalling, chipping and wear of such coatings could lead to premature damage to the projection to which it was applied.

SUMMARY OF THE INVENTION

It is a principal object of the present invention to provide, for a projection from the airfoil of a turbomachinery blade, an improved contact surface means resistant to the combination of adhesive wear and impact.

Another object is to provide an improved method for securing such a surface means to the projection.

These and other objects and advantages will be more fully understood from the following detailed description, the drawing and the specific examples, all of which is intended to be typical of rather than in any way limiting on the scope of the invention.

DESCRIPTION OF THE PREFERRED EMBODIMENTS

The present invention is particularly useful with the types of turbomachinery blades, which term is intended to include vanes within its meaning, including those types of substantially lateral projections positioned along the airfoil to provide midspan shrouds, platforms, damping means, etc. Typical examples of such turbomachinery blades are shown in U.S. Pat. Nos. 3,734,646-Perkins issued May 22, 1973 and 3,936,234-Tucker et al, issued Feb. 3, 1976, the disclosures of which are incorporated herein by reference. Typically, blades including such midspan projections can be found in gas turbine engines in such sections as the fan section, the compressor section and the turbine section.

In order to avoid the adhesive wear which can result from rubbing and impacting interfacing of such projections during operation of turbomachinery, commercially available tungsten carbide (WC) powder in a cobalt binder has been flame sprayed on the mating or interfacing surfaces of such projections or shrouds. Such wear protection is particularly needed for use with titanium alloy blade shroud interlock surfaces used in the fan and compressor sections of certain gas turbine engines. It has been found, however, that the wear material composition and structure can be difficult to control through spray deposition in order to maintain reproducible wear properties. In addition, control of thickness and surface finish can be difficult.

Figure 1:
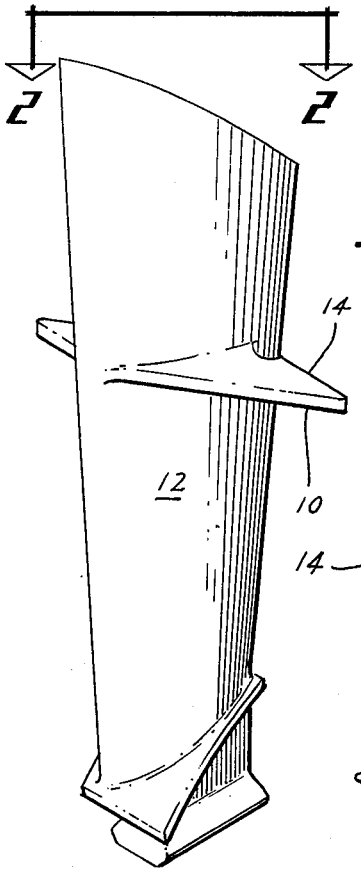
FIG. 1 is a perspective view of a gas turbine engine blade which includes a midspan shroud.
Figure 2:
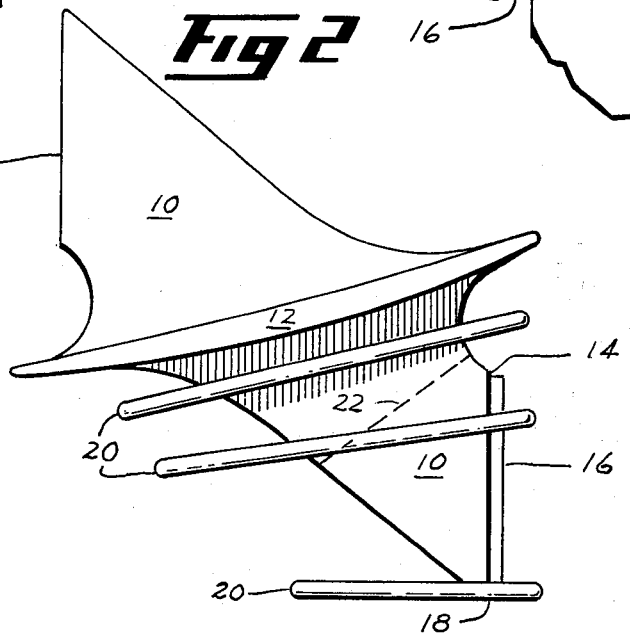
FIG. 2 is an enlarged top view of the blade of FIG. 1 taken along lines 2—2.
Figure 3:
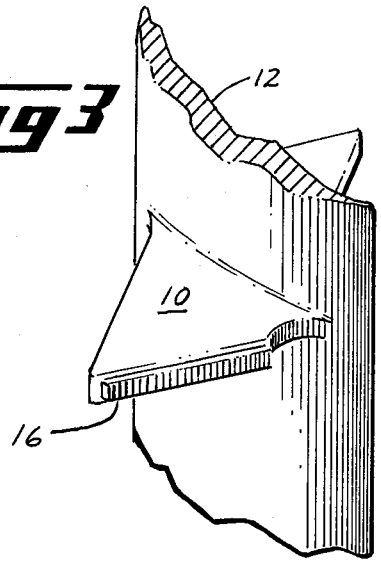
FIG. 3 is a fragmentary view of the blade of FIG. 2.

Shown in the perspective view of FIG. 1, the top view of FIG. 2, taken along line 2—2 of FIG. 1, and the fragmentary view of FIG. 3 is a typical gas turbine engine blade including a pair of midspan shroud projections 10 from airfoil 12. During operation, such shrouds or projections are intended to cooperate, abut or mate at surface 14 in FIG. 1 with similar projections from adjacent blades, for example in the general manner shown in the above-incorporated U.S. Pat. No. 3,734,646.

Figure 4:
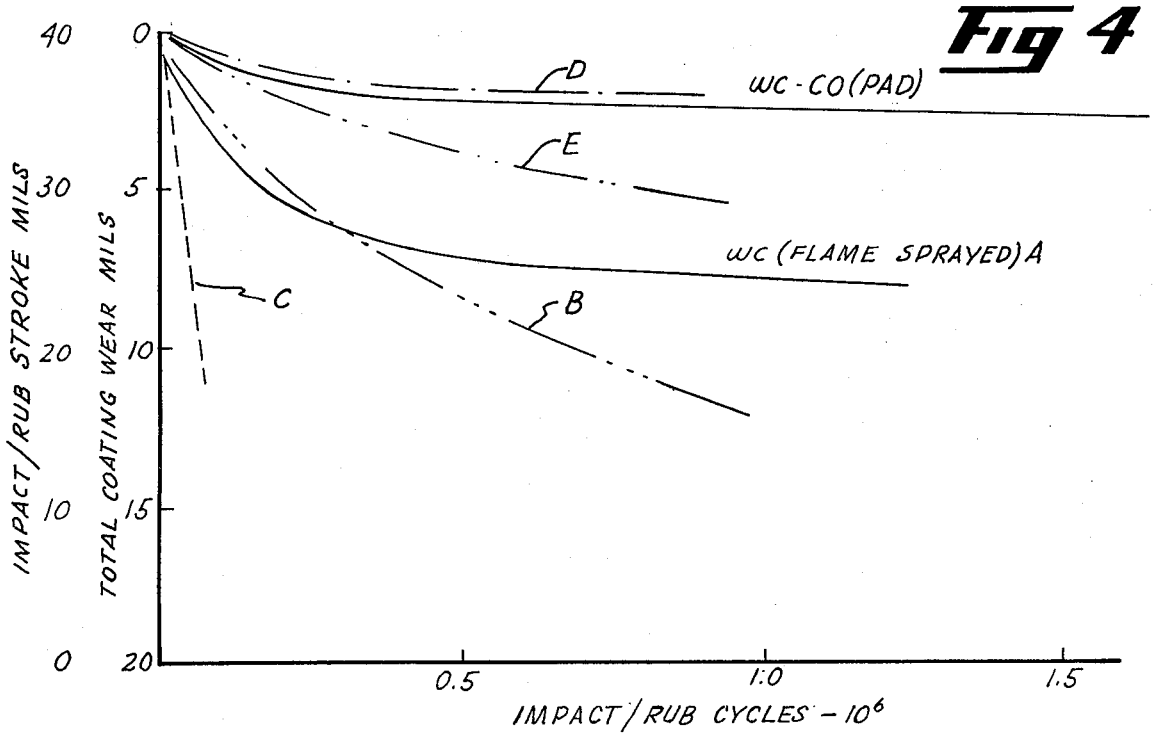
FIG. 4 is a graphical comparison between the wear pad employed in the present invention and other surface means to avoid adhesive wear.

In order to improve upon the WC-base flame-sprayed wear protection system on midspan shrouds used in certain gas turbine engines, a variety of materials including additional flame-sprayed materials and sintered pads of WC-Co were evaluated. Initial tests, prior to actual engine evaluations, were conducted on specimens in apparatus which subjected test surfaces to a combination of impacting and rubbing, producing a repetitive scuffing action under adjustable parameters of impact velocity, rub displacement, nominal contact pressure and specimen bulk temperature for a given number of impact/rub cycles. In initial evaluations, it was recognized that substantially fully dense, compacted, sintered pads of WC-Co provided significant improvement in the combination of adhesive wear resistance and impact toughness compared with the currently used WC flame sprayed surface. This is represented by the data in FIG. 4 by the solid lines. Recognition of the unusual improvement in such characteristics through such sintered pads resulted in an additional evaluation of the composition of tungsten carbide-cobalt. The following Table summarizes some of the data obtained in such evaluation.

TABLE

PROPERTIES OF VARIOUS GRADES OF COMPACTED, SINTERED WC-Co

| Example | Composition(wt %) WC | Co | Hardness RA | Density g/cc | UCS Kpsi | E $10^6$ psi | Charpy in-lb | Abrasion (Vol. loss)$^{-1}$ | $\alpha$ $10^{-6}$ in/in/°F. 0–400° F. |
|---|---|---|---|---|---|---|---|---|---|
| 1 | 87 | 13 | 88.2 | 14.2 | 530 | 79 | 17 | 4 | 3.0 |
| 2 | 91 | 9 | 89.5 | 14.7 | 600 | 88 | 12 | 10 | 2.7 |
| 3 | 94 | 6 | 92.0 | 15.0 | 680 | 94 | 12 | 35 | 3.0 |
| 4 | 90 | 10 | 92.0 | 14.6 | 750 | 90 | 15 | 13 | — |
| 5 | 94 | 6 | 93 | 15.0 | 860 | 89 | 9 | 60 | 2.9 |

The compacted, sintered WC-Co specimens from which the data of the above Table were generated had a density in the range of 14.2–15.0 g/cc, indicating that they were substantially fully dense. In addition, their coefficient of thermal expansion ($\alpha$) over the intended operating temperature range of up to 400° F. was in the range of 2.7–3.0, indicating their compatibility with the base metal to which they were bonded (about 4.7). In this series of examples a Ti-base alloy consisting nominally, by weight, of 6% Al, 4% V with the balance Ti(Ti-6-4 alloy) was the base metal to which the specimens were brazed. In the above Table, "RA" means Rockwell A, "UCS Kpsi" means ultimate compressive strength in thousands of pounds per square inch, and "E" means modulus of elasticity.

Comparison of the data associated with Examples 3 and 5, which were for the same composition but with variations in particle size and distribution as well as in processing, shows that the preferred form of the present invention of greater than 90% up to about 95% WC, with the balance Co, provides significantly improved abrasion resistance. Specimen pads of the WC-Co material were induction brazed to backing members of Ti-6-4 alloy using a titanium-base brazing alloy.

After establishing the preferred nominal composition of, by weight, 95% WC with the balance Co as having the capability of providing the improved combination of adhesive wear resistance and impact toughness, additional comparisons were made with modified flame-sprayed WC-Co. As shown by the property comparison in FIG. 4, two flame-sprayed modifications (B and C) fell below that currently used in gas turbine application (A), one (D) was slightly superior to the WC-Co pad of Example 3, and one (E) was superior to A but lower than the compacted, sintered pad. Although flame-sprayed coating D exhibited good wear resistance, equivalent to the pad associated with the present invention, it exhibited cracking and loss of coating chunks indicating a lack of impact resistance or toughness. Therefore, such coating was considered to be unsuitable as a contact surface means on a turbomachinery blade for resistance to both adhesive wear and impact.

Compacted, sintered, substantially fully dense members based on carbides, nitrides and borides are commercially available, for example for use as a cutting tool. However, brazing such members to a turbomachinery blade of titanium alloy presented some serious problems. Such problems were based, at least in part, on the change in mechanical properties resulting from heating a titanium alloy, for example of the Ti-6-4 type, above its beta transus temperature, for example about 1750–1800° F. Ordinary brazing procedures would raise the entire blade above that temperature even though such higher temperature was needed only at the juncture of bonding. Substitution of localized heating procedure such as precision vacuum induction heating to localize the application brazing heat precisely at the desired area was found, according to the method associated with the present invention, to minimize the effect of heating a titanium-base alloy above its beta transus temperature.

Induction heating apparatus, useful with the present invention though applied in a somewhat different manner, is shown in the description of U.S. Pat. No. 4,012,616-Zelahy, the disclosure of which is incorporated herein by reference. By locating a substantially fully dense, compacted, sintered WC-Co pad 16 in FIG. 2, on the surface 14 of the midspan shroud shown in FIGS. 1 and 2, with a brazing alloy 18 in FIG. 2 placed between pad 16 and surface 14, induction heating coils 20 can be positioned about midspan shroud 10 such as in the positions shown in FIG. 2 to apply appropriate heat locally in the area of pad 16 in order to braze pad 16 to surface 14. Through practice of such a localized heating method, the formation of beta structure, generated by heating above the beta transus temperature of the alloy in order to braze pad 16 to surface 14, can be limited substantially to the area at the tip of midspan shroud 10 limited by a boundary approximately at broken line 22. The temperature of heating will depend upon selection of the brazing alloy used for bonding. Many are commercially available. In this way, a wear pad having the combination of both adhesive wear resistance and impact toughness was secured to the contact surface of an airfoil projection of a turbomachinery blade without adversely affecting mechanical properties of the airfoil to which the projection carrying the contact surface is attached or is integral with.

In one specific example, a pad shaped generally as shown at 16 in FIGS. 2 and 3, from the material of Example 3, was brazed to a blade midspan shroud surface 14 of Ti-6-4 alloy at a temperature of about 1750° F. in vacuum using a titanium-base brazing alloy. The pad was held in place by retainer means (not shown) and the induction coils were positioned approximately as shown in FIG. 2. The result was WC-Co pad secured brazing to an airfoil projection as shown in FIG. 3.

It is believed that the substantially fully dense, compacted, sintered members of the present invention require a thickness of a least about 0.01" to avoid breakage during handling. Greater than about 0.06" thick material is not required because of the resistance of the pad associated with the present invention to adhesive wear and impact. The pads evaluated in connection with the present invention were predominantly about 0.02" in thickness.

Wear pads of the material of Example 3 were prepared and bonded to airfoil midspan shrouds, as described above, for testing in a gas turbine engine. Visual inspections were performed after initial engine running and at 25 and 50 hour intervals thereafter. After disassembly, inspection revealed excellent appearance: the areas of contact on the pad were only burnished to bright, smooth finish. There was no evidence of braze or pad cracking under 10× magnification.

Thus, the present invention has provided a wear pad as a separate, discreet member bonded at the contact surface of a turbomachinery blade projection, the pad providing such surface with an improved combination of adhesive wear resistance and impact toughness. Use of localized heating, for example, vacuum induction brazing, with such member has provided an improved method for securing the pad to such contact surface, avoiding heating the blade airfoil portions carrying the projection in manner which could be detrimental to the mechanical properties of the airfoil. It should be recognized that other localized heating procedures, such as torch brazing, resistance brazing, laser heating, electron beam heating, etc., with proper control, can be used in the practice of the present invention.

Although the present invention has been described in connection with specific examples, it will be readily recognized by those skilled in the art the variations and modifications of which the invention is capable. For example, a variety of brazing alloys in such forms as powder, foil, etc. can be used in the practice of the vacuum induction brazing process using known methods of holding the brazing alloy in place. For example, acrylic cement frequently is used. In addition, the brazing alloy and the particular material of the pad can be selected dependent upon the conditions of intended use and and the material of the blade to which the pad is being secured.

What is claimed is:

1. A turbomachinery blade including an airfoil and a projection from the airfoil, the projection having a contact surface which abuts a surface of an adjacent member, the contact surface including surface means to avoid adhesive wear, the improvement wherein:

the contact surface has secured thereto, as the surface means, a discrete wear pad of an improved combination of adhesive wear resistance and impact toughness, the pad:

a. comprising a substantially fully dense, compacted, sintered member of, by weight, greater than 91% up to about 95% WC, with the balance Co;

b. being of a thickness of at least about 0.01"; and c. having thermal expansion characteristics compatible with the projection over an intended operating temperature range.

2. The turbomachinery blade of claim 1 in which the wear pad comprises, nominally by weight, about 94% WC, with the balance Co.

* * * * *